US008020847B2

(12) United States Patent
Dawley

(10) Patent No.: US 8,020,847 B2
(45) Date of Patent: Sep. 20, 2011

(54) MULTIPLE DELIVERY WEB CONVERSION APPARATUS AND METHOD OF PRODUCING AND DELIVERING VARIABLE PRINTED PRODUCTS

(75) Inventor: Douglas Joseph Dawley, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 74 days.

(21) Appl. No.: 12/322,768

(22) Filed: Feb. 6, 2009

(65) Prior Publication Data

US 2010/0201066 A1 Aug. 12, 2010

(51) Int. Cl.
*B65H 39/02* (2006.01)

(52) U.S. Cl. ..... 270/52.17; 270/52.09; 270/52.12

(58) Field of Classification Search ..... 270/5.02, 270/5.03, 21.1, 52.09, 52.12, 52.17
See application file for complete search history.

(56) References Cited

U.S. PATENT DOCUMENTS

| | | | | |
|---|---|---|---|---|
| 2,019,658 | A | 11/1935 | Crafts | |
| 2,361,459 | A | 10/1944 | Corbin | |
| 2,395,950 | A | 3/1946 | Wolf | |
| 2,631,845 | A * | 3/1953 | Zuckerman | 270/5.02 |
| 3,623,722 | A | 11/1971 | Sjogren et al. | |
| 3,717,249 | A | 2/1973 | Faley | |
| 3,889,939 | A | 6/1975 | Faltin | |
| 3,915,445 | A | 10/1975 | Duncan et al. | |
| 3,948,504 | A | 4/1976 | Woessner et al. | |
| 3,964,598 | A | 6/1976 | Alsop | |
| 4,026,537 | A * | 5/1977 | Harris | 270/14 |
| 4,034,973 | A | 7/1977 | Hams | |
| 4,050,686 | A | 9/1977 | McCain et al. | |
| 4,279,410 | A | 7/1981 | Bolza-Schuenemann | |
| 4,466,603 | A | 8/1984 | Schnell | |
| 4,533,132 | A | 8/1985 | Wangermann | |
| 4,534,552 | A | 8/1985 | Rahe | |
| 4,545,782 | A | 10/1985 | Niemiro et al. | |
| 4,593,893 | A * | 6/1986 | Suter | 270/52.12 |
| 4,729,282 | A | 3/1988 | Kasdorf | |
| 4,919,027 | A | 4/1990 | Littleton | |
| 5,014,975 | A | 5/1991 | Hamricke | |
| 5,080,338 | A | 1/1992 | Belanger et al. | |
| 5,098,075 | A * | 3/1992 | Lindblom | 270/52.14 |

(Continued)

OTHER PUBLICATIONS

Vits-Multicut HP Servo Drive Sheeter; http://www.vits.com/index_en.php?level=3&CatID=3.13.16.49&inhalt_id=47 (accessed Feb. 4, 2009).

(Continued)

*Primary Examiner* — Patrick Mackey
(74) *Attorney, Agent, or Firm* — Davidson, Davidson & Kappel, LLC

(57) ABSTRACT

A web conversion and delivery apparatus is provided. The web conversion and delivery apparatus comprises a first delivery for transporting printed products, a second delivery for transporting printed products and a cutting apparatus upstream of the first delivery and the second delivery. The cutting apparatus is capable during a first print job of cutting first images of the fixed image length into first printed products for delivery to the first delivery. The second delivery is inactive during the first print job. The cutting apparatus is capable during a second print job of cutting second images of the fixed image length into second printed products for delivery to the first delivery and the second delivery. The second printed products have a length that is different from the first printed products. A printing press and a method of producing and delivering printed products of variable lengths are also provided.

21 Claims, 4 Drawing Sheets

U.S. PATENT DOCUMENTS

| | | | | |
|---|---|---|---|---|
| 5,176,371 | A | 1/1993 | Rau et al. | |
| 5,293,797 | A | 3/1994 | Spalding et al. | |
| 5,354,047 | A | 10/1994 | Chesnutt et al. | |
| 5,405,127 | A | 4/1995 | Welborn | |
| 5,439,206 | A | 8/1995 | Raasch et al. | |
| 5,522,586 | A | 6/1996 | Bennett et al. | |
| 5,538,242 | A | 7/1996 | Doucet | |
| 5,542,547 | A | 8/1996 | Ricciardi | |
| 5,707,054 | A | 1/1998 | Loquet et al. | |
| 6,062,372 | A | 5/2000 | Cote et al. | |
| 6,231,044 | B1 | 5/2001 | Neary et al. | |
| 6,341,773 | B1 | 1/2002 | Aprato et al. | |
| 6,360,640 | B1 | 3/2002 | Cote | |
| 6,439,562 | B1 | 8/2002 | Cote et al. | |
| 6,443,449 | B1 | 9/2002 | Takagi et al. | |
| 6,572,097 | B2 | 6/2003 | d'Agrella et al. | |
| 6,588,739 | B1 | 7/2003 | Weis | |
| 6,684,746 | B2 | 2/2004 | Hilliard et al. | |
| 7,621,857 | B2 | 11/2009 | Pompile | |
| 2001/0022421 | A1 | 9/2001 | Schaefer et al. | |
| 2004/0060464 | A1 | 4/2004 | Birkenfeld et al. | |
| 2004/0135303 | A1 | 7/2004 | Weiler | |
| 2005/0124481 | A1 * | 6/2005 | d'Agrella et al. | 493/405 |
| 2006/0144507 | A1 | 7/2006 | Herbert et al. | |
| 2006/0180438 | A1 | 8/2006 | Mosli et al. | |
| 2007/0062392 | A1 | 3/2007 | Ratz | |
| 2007/0068408 | A1 | 3/2007 | Christmann et al. | |
| 2008/0112743 | A1 | 5/2008 | Moore | |
| 2008/0128983 | A1 | 6/2008 | Prim et al. | |
| 2008/0190309 | A1 | 8/2008 | Rancourt et al. | |
| 2009/0127763 | A1 | 5/2009 | Cossette | |
| 2010/0201056 | A1 | 8/2010 | Dawley | |
| 2010/0201058 | A1 | 8/2010 | Dawley et al. | |
| 2010/0201065 | A1 | 8/2010 | Dawley et al. | |

OTHER PUBLICATIONS

Vits Rotocut S; http://www.vits.com/index_en.php?level=3&CatID=3.13.16.49&inhalt_id=43 (accessed Feb. 4, 2009).

Vits Rotocut HS; http://www.vits.com/index_en.php?level=3&CatID=3.13.16.49&inhalt_id=44# (accessed Feb. 4, 2009).

Innotech High Speed Sheeters; http://www.innotechequip.com/sheeter.htm (accessed Feb. 4, 2009).

Innotech Finishing Line Equipment; http://www.innotechequip.com/finishing.htm (accessed Feb. 4, 2009).

Goss International; M-600 Folia: High Productivity Perfecting Press; 2008 (accessed from http://www.gossinternational.com/clientuploads/folia/downloads.htm, on Feb. 5, 2009).

Goss International; M-600: 16-Page Web Offset Press Systems; Aug. 5, 2008 (accessed from http://gossinternational.com/index.php?src=gendocs&ref=m600&category=en_Products, on Feb. 5, 2009).

Manroland; Roland 900: Printing Units, Dimensions and Details; http://www.manroland.com/com/pdf_en/MR_ROLAND_900_Datenblatt_e.pdf (accessed Feb. 5, 2009).

Manroland; Nothing Can Replace Capacity: The Roland 900; http://www.manroland.com/com/pdf_en/MR_ROLAND_900_Broschuere_e.pdf (accessed Feb. 5, 2009).

U.S.P.T.O. Office Action in U.S. Appl. No. 12/322,738 (Pub. 2010/0201065) dated Sep. 15, 2010.

U.S.P.T.O. Office Action in U.S. Appl. No. 12/322,767 (Pub. 2010/0201058) dated Sep. 14, 2010.

U.S.P.T.O. Office Action in U.S. Appl. No. 12/322,775 (Pub. 2010/0201056) dated Dec. 28, 2010.

* cited by examiner

MULTIPLE DELIVERY WEB CONVERSION APPARATUS AND METHOD OF PRODUCING AND DELIVERING VARIABLE PRINTED PRODUCTS

The present invention relates generally to printing presses and more particularly to web conversion and delivery apparatuses in printing presses.

BACKGROUND OF INVENTION

U.S. Pat. No. 4,279,410 discloses a method and apparatus for folding sheet stacks in a web-fed rotary printing press. The sheet stacks are severed from groups of paper ribbons and are conveyed by suitable conveying cylinders to spaced folding tables. Each folding table is provided with rotating folding blades and cooperating driving folding roller pairs. Each folding table is further provided with a pulse absorber assembly having a plurality of stop rods or bars which are positioned to contact the leading edge of each group of sheet stacks to halt the motion of the stacks on the folding tables. The halted sheet stacks are then folded.

U.S. Pat. No. 5,538,242 discloses a folder apparatus for a web-fed printing press. The printed webs are conducted over a former and folded. After being folded, the web is fed through the nips of upper and lower draw rollers and guide rollers to a cutting cylinder, which severs the web to form printed signatures. A web separating device is provided between the upper draw rollers and the lower draw rollers. The signatures are then fed by a lead-in tape system to fan pockets of two fans. As the fans rotate, the signatures are deposited to two stacks.

U.S. Pat. No. 6,231,044 discloses a delivery portion of a folder of a high speed printing press which includes a diverting section and a bucket section. Successive folded and cut signatures enter the diverting section from the cutting cylinders and are positioned between driven transport tapes. The signatures are diverted into a first or a second signature path and, most typically the signatures are diverted alternately to the first path then to the second path. After being diverted, the signatures enter the bucket section of the folder. Signatures on the first path are transported between the tapes to a first rotating bucket assembly and the signatures on the path are transported between the tapes to a second rotating bucket assembly. The first bucket assembly transfers and slows down signatures diverted along the first path to a first conveyor and the second bucket assembly transfers signatures diverted along the second path to a second conveyor. The conveyors transport the signatures in a shingled stream to an area for accumulation or further processing, such as to a stacker.

U.S. Publication No. 2001/0022421 discloses a delivery apparatus for sorting a single stream of signatures into two or more streams, the apparatus includes two counter-rotating bucket assemblies. Each bucket assembly includes a plurality of buckets spaced from one another along a common axis. The two bucket assemblies operate to sort the single stream of signatures into two streams and also slow down the signatures. Stripping assemblies operate to remove a signature at a time from a respective bucket. The signature then falls upon a conveyor where successive signatures are arranged in a shingled stream.

BRIEF SUMMARY OF THE INVENTION

A web conversion and delivery apparatus is provided. The web conversion and delivery apparatus comprises a first delivery for transporting printed products, a second delivery for transporting printed products and a cutting apparatus upstream of the first delivery and the second delivery. The cutting apparatus is capable during a first print job of cutting first images of the fixed image length into first printed products for delivery to the first delivery. The second delivery is inactive during the first print job. The cutting apparatus is capable during a second print job of cutting second images of the fixed image length into second printed products for delivery to the first delivery and the second delivery. The second printed products have a length that is different from the first printed products.

A printing press is also provided. The printing press includes a printing unit for printing images of a fixed image length on a web, a slitter downstream of the printing unit for slitting the web into at least two ribbons, a former downstream of the printing unit for longitudinally folding the at least two ribbons, a first delivery for transporting printed products, a second delivery for transporting printed products and a cutting apparatus upstream of the first delivery and the second delivery. The cutting apparatus is capable during a first print job of cutting first images of the fixed image length into first printed products for delivery to the first delivery. The second delivery is inactive during the first print job. The cutting apparatus is capable during a second print job of cutting second images of the fixed image length into second printed products for delivery to the first delivery and the second delivery. The second printed products have a length that is different from the first printed products.

A method of producing and delivering printed products of variable lengths is also provided. The method includes the steps of cutting first images of a fixed image length on a printed web with a cutting apparatus to create first printed products for a first print job; transporting the first printed products a first delivery; cutting second images of the fixed image length on a printed web with a cutting apparatus to create second printed products for a second print job; and transporting the second printed products to the first delivery and the second delivery. The second delivery is inactive during the first-print job. The second printed products have a length that is different from the first printed products.

BRIEF DESCRIPTION OF THE DRAWINGS

The present invention is described below by reference to the following drawings, in which.

DETAILED DESCRIPTION

Web-conversion apparatuses convert webs of printed material into intermediate printed products or final printed products. An example of a web-conversion apparatus is a sheeter, which converts a continuous web of material into individual sheets. Another example is a folder, which converts continuous webs of material into individual folded products.

A sheeter can vary the length of a sheet the sheeter delivers by varying the knife-to-knife cut distance at the web. A sheeter cannot deliver a folded product, nor can it deliver different forms to different deliveries.

A folder delivers a product that has a cut-off length equal to the image repeat length, divided by some integer. For example, a Goss International 22 inch PFF-3 pinless former folder delivers an 11 inch product and a Goss International 40 inch PCF-3 pinless combination folder delivers a 10 inch product.

Figure 1:
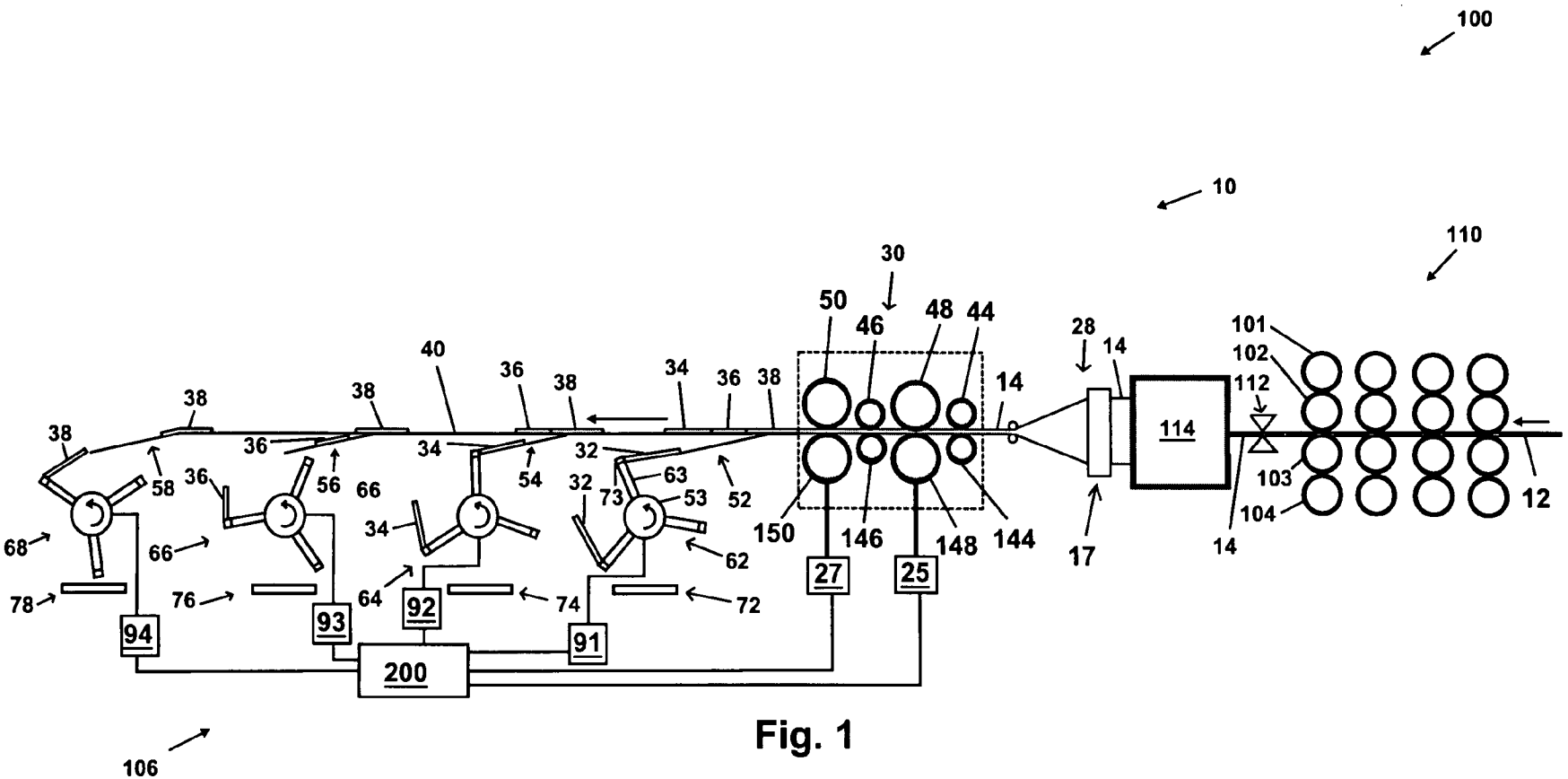
FIG. 1 shows a schematic side view of a printing press including a web-conversion apparatus according to an embodiment of the present invention.

FIG. 1 shows a schematic side view of a printing press 100 including a web-conversion apparatus 10 according to an embodiment of the present invention. Printing units 110, each including an upper plate cylinder 101, an upper blanket cylinder 102, a lower blanket cylinder 103 and a lower plate cylinder 104, act together to print four color images on a web 12. The term image used herein includes text, graphics or printed indicia on web 12, with each image have a length equal to a circumferential printing length of each plate cylinder 101, 104 and including contents of a number of pages of final printed products produced by printing press 100. After images are printed on web 12, web 12 passes through a slitter 112, which longitudinally slits web 12 into a plurality of ribbons 14. A ribbon guiding section 114 may then turn and offset ribbons 14 so ribbons 14 are vertically aligned and traveling in a horizontal plane as ribbons 14 pass through vertically aligned nip rolls 17 and enter a former 28. Former 28 imparts a longitudinal fold upon ribbons 14 such that ribbons 14 are horizontally aligned and traveling substantially in the same horizontal plane as ribbons exit former 28. Ribbons 14 may also be slit over former 28 to yield twice as many unfolded ribbons 14. Web 12 and ribbons 14 may travel at a velocity V1.

Once longitudinally folded, ribbons 14 are cut by a cutting assembly 30 into successive intermediate printed products or signatures 32, 34, 36, 38. Cutting assembly 30 includes cut cylinders 48, 50 interacting with respective anvil cylinders 148, 150 to create signatures 32, 34, 36, 38. Cut cylinder 48 may include one or more knives that are segmented and partially cut, or perforate, ribbons 14 by contacting anvils on anvil cylinder 148. Cut cylinder 50 may include knives that finish the partial cuts created by knives of cut cylinder 48, forming signatures 32, 34, 36, 38, by contacting anvils on anvil cylinder 150. Knives on cut cylinder 50 may also be segmented. Cutting assembly 30 may include a first pair of nip rollers 44, 144, and a second pair of nip rollers 46, 146. Nip rollers 44, 144, 46, 146 deliver ribbons 14 to cut cylinder 48 where knife blades perforate ribbons 42 with a first cut. The process of partially cutting ribbons with cut cylinder 48 and finishing the cut with cut cylinder 50 may be referred to as a double cut. In another embodiment, ribbons 14 may also be cut completely by cut cylinder 50 and anvil cylinder 150, making the perforation by cut cylinder 48 and anvil cylinder 148 unnecessary.

In this embodiment, printing units 110 print successive four-color images on both sides of web 12, each image being aligned with an image on the opposite side of web 12. Each image includes the contents of 32 pages of final printed products produced from the image, so that a length of web 12 with an image on both sides includes the contents of 64 pages of the final printed products. Cutting assembly 30 forms four individual signatures 32, 34, 36, 38 from each image printed on web 12 by printing units 110, with each signature including 16 pages (8 pages, printed on both front and back). For example, ribbons 14 are cut by cutting assembly 30 such that one cut by cut cylinder 50 creates a lead edge of one first signature 32, a subsequent by cut cylinder 50 creates a lead edge of one second signature 34 and a tail edge of the one first signature 32, a subsequent by cut cylinder 50 creates a lead edge of one third signature 36 and a tail edge of the one second signature 34, a subsequent by cut cylinder 50 creates a lead edge of one fourth signature 38 and a tail edge of the one third signature 36 and a subsequent by cut cylinder 50 creates a lead edge of one subsequent first signature 32 and a tail edge of the one fourth signature 38. In the embodiment where a double cut is performed, each cut by cut cylinder 50 creating edges of signatures finishes a partial cut created by cut cylinder 48. In the embodiment where only cut cylinder 50 is provided, and not cut cylinder 48, each cut by cut cylinder 50 cuts entirely through ribbons 14.

Cylinders 48, 148 may be phased with respect to cylinders 50, 150, with cylinders 48, 148 being driven by a servomotor 25 at varying velocities during each revolution and cylinders 50, 150 being driven by a servomotor 27 at varying velocities during each revolution so that printed signatures 32, 34, 36, 38 may vary in length. Servomotors 25, 27 may be controlled by a controller 200. Any combination of cutoff lengths for signatures 32, 34, 36, 38 is possible, as long as the sum of the cutoff lengths equal the length of each four-color image printed by printing units 110. For example, if plate cylinders 101, 104 and blanket cylinders 102, 103 each have a printing circumference of 44 inches and print images that are 44 inches in length on web 12, signature 32 may have a cutoff length of 15 inches, signature 34 may have a cutoff length of 10 inches, signature 36 may have a cutoff length of 11 inches and signature 38 may have a cutoff length of 8 inches.

Signatures 32, 34, 36, 38, traveling away from cutting assembly 30 enter a delivery section 106 where conveyor 40 transports signatures 32, 34, 36, 38 at a second velocity V2 away from cutting assembly 30. Velocity V2 may be greater than velocity V1. Conveyor 40 may be in the form of transport tapes, which grip a lead edge of ribbons 13 just as ribbons 14 are cut by cut cylinder 50 and positively grip signatures 32, 34, 36, 38 by contacting signatures 32, 34, 36, 38 from above and below. Guide belts may be provided to assist in guiding ribbons 14 into cutting assembly and signatures 32, 34, 36, 38 towards conveyor 40. The guide belts may be provided in circumferential cutouts spaced axially in cylinders 48, 50, 148, 150 and rolls 44, 46, 144, 146. In an alternative embodiment, the guide belts may be introduced only between cut cylinder 48 and cut cylinder 50 to control the printed product while the uncut portions of ribbons 14 are cut by cut cylinder 50.

Signatures 32, 34, 36, 38 are diverted from conveyor 40 by respective diverter assemblies 52, 54, 56, 58. Diverter assemblies 52, 54, 56, 58 force respective signatures 32, 34, 36, 38 out of the path of conveyor 40 and down to respective deceleration assemblies 62, 64, 66, 68.

A first diverter assembly 52 removes signatures 32 from conveyor 40 and transports signatures 32 to a first deceleration assembly 62. First deceleration assembly 62, rotating about a first axis that is perpendicular to the direction of travel of conveyor 40, grips signatures 32 and delivers signatures 32 to first delivery section 72. First delivery section 72, which may be a conveyor running axially with respect to deceleration assembly 62 in a second horizontal plane below the horizontal plane of conveyor 40, carries signatures 32 away from deceleration assembly 62.

Signatures 34, 36, 38 are transported by conveyor 40 past first diverter assembly 52. A second diverter assembly 54 removes signatures 34 from conveyor 40 and transports signatures 34 to a second deceleration assembly 64. Second deceleration assembly 64, rotating about a second axis that is perpendicular to the direction of travel of conveyor 40, grips signatures 34 and delivers signatures 34 to second delivery section 74. Second delivery section 74, which may be a conveyor running axially with respect to deceleration assembly 64 in the second horizontal plane below the horizontal plane of conveyor 40, carries signatures 34 away from deceleration assembly 64.

Signatures 36, 38 are transported by conveyor 40 past second diverter assembly 54. A third diverter assembly 56 removes signatures 36 from conveyor 40 and transports signatures 36 to a third deceleration assembly 66. Third deceleration assembly 66, rotating about a third axis that is perpendicular to the direction of travel of conveyor 40, grips signatures 36 and delivers signatures 36 to third delivery section 76. Third delivery section 76, which may be a conveyor running axially with respect to deceleration assembly 66 in the second horizontal plane below the horizontal plane of conveyor 40, carries signatures 36 away from deceleration assembly 66.

Signatures 38 are transported by conveyor 40 past third diverter assembly 56. A fourth diverter assembly 58 removes signatures 38 from conveyor 40 and transports signatures 38 to a fourth deceleration assembly 68. Fourth deceleration assembly 68, rotating about a fourth axis that is perpendicular to the direction of travel of conveyor 40, grips signatures 38 and delivers signatures 38 to fourth delivery section 78. Fourth delivery section 78, which may be a conveyor running axially with respect to deceleration assembly 68 in the second horizontal plane below the horizontal plane of conveyor 40, carries signatures 38 away from deceleration assembly 68. In an alternative embodiment, fourth diverter assembly 58 is not necessary, and conveyor 40 may transport signatures 38 directly to fourth deceleration assembly 68.

Signatures 32, 34, 36, 38 may be transported by respective delivery sections 72, 74, 76, 78 at a velocity V3, which may be less than velocity V2, to downstream finishing operations.

Each deceleration assembly 62, 64, 66, 68 may include a center body 53, arms 63, and grippers 73, respectively. Arms 63 protrude radially from center bodies 53 and grippers 73, which are configured to engage signatures 32, 34, 36, 38, are positioned at ends of arms 63.

Figure 2:
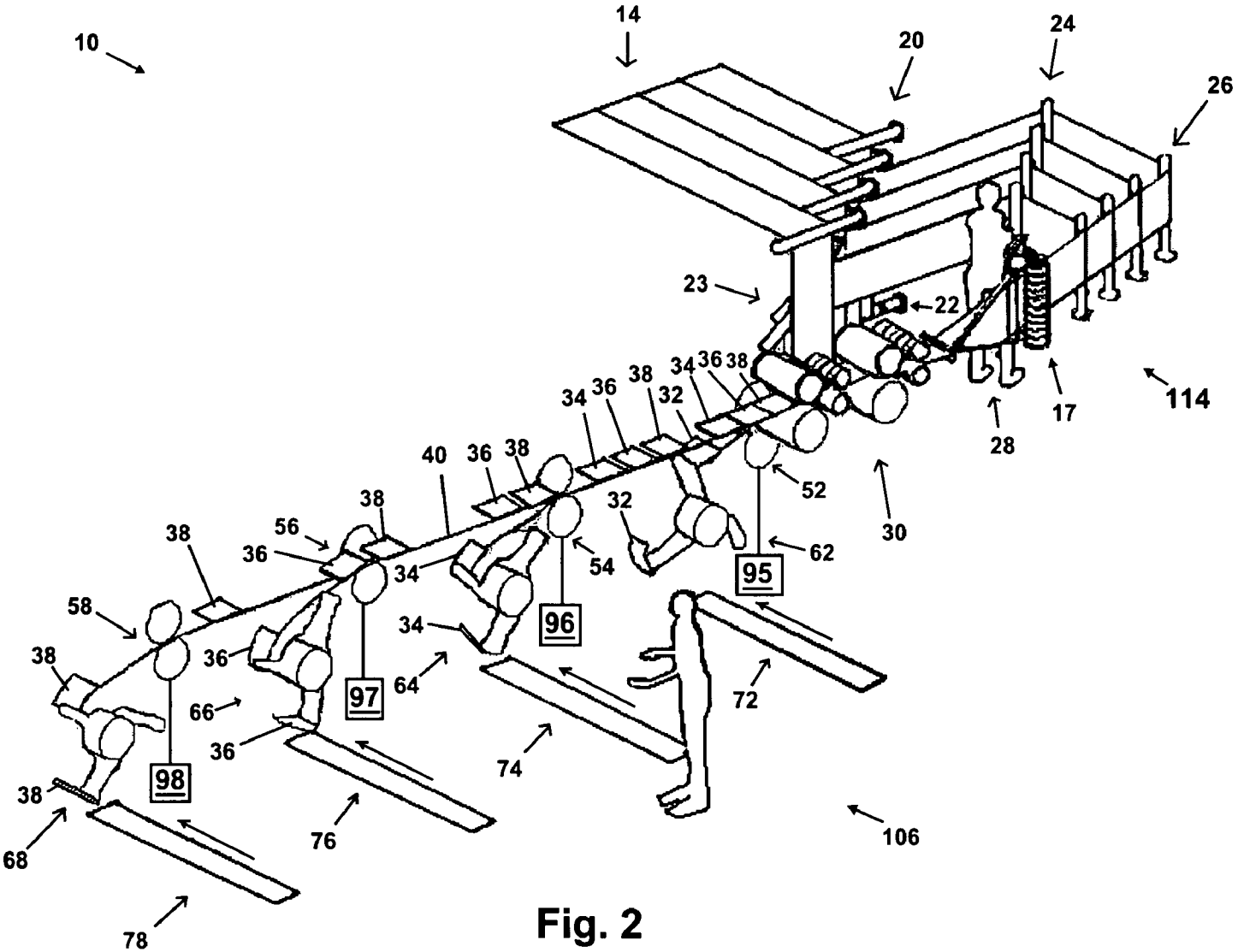
FIG. 2 shows a perspective view of the web-conversion apparatus shown in FIG. 1.

Diverting assemblies 52, 54, 56, 58 and deceleration assemblies 62, 64, 66, 68 are phased so that diverting assemblies remove respective signatures 32, 34, 36, 38 from conveyor 40 in a proper orientation and arms 63 of deceleration assemblies 62, 64, 66, 68 are in proper positions to receives signatures 32, 34, 36, 38 from diverting assemblies 52, 54, 56, 58, respectively. Deceleration assemblies 62, 64, 66, 68 may driven by respective motors 91, 92, 93, 94, and diverting assemblies may be driven by respective motors 95, 96, 97, 98 (FIG. 2). Motors 91, 92, 93, 94, 95, 96, 97, 98 may be servomotors and may be controlled by controller 200 to ensure proper phasing.

In alternative embodiments, cutting assembly 30 may be configured to cut each image into a different number of signatures, for example three. The number of delivery assemblies, deceleration assemblies and delivery sections may be adjusted to match the maximum number of signatures produced by cutting assembly 30.

Web conversion apparatus 10 may also be adjusted to produce less than four signatures from each image printed by plate cylinders 102, 104, by cutting each image into less printed products and using less than four of diverting assemblies 52, 54, 56, 58, less than four of deceleration assemblies 62, 64, 66, 68 and less than four delivery sections 72, 74, 76, 78. For example, web conversion apparatus 10 may be adjusted to accommodate three signatures from one image by inactivating diverting assembly 58, deceleration assembly 68 and delivery section 78 and rephrasing diverting assemblies 52, 54, 56 and deceleration assemblies 62, 64, 66. For example, if for a one print job, plate cylinders 101, 104 each print images having a fixed image length of 44 inches (i.e. each plate cylinder 101, 104 has a printing circumference of 44 inches), cutting assembly 30 may cut each 44-inch image printed by plate cylinders 101, 104 into four printed products each having a length of 11 inches and each printed product can be delivered to a respective delivery section 72, 74, 76, 78. If a user then desires, for a subsequent print job, that plate cylinders 101, 104 print different 44-inch images and only three printed products are desired for each 44-inch image printed on web 12, each 44-inch printed image is cut into three 14 and ⅔-inch products and each printed product can be delivered to a respective delivery section 72, 74, 76, with delivery section 78 being inactivated and not receiving printed products.

In other embodiments, web conversion and delivery apparatus 10 may be configured such that web 12 is not slit into ribbons 14 and/or web 12 is not folded longitudinally by former 28. The term web as used herein is defined such that web may also include ribbons.

FIG. 2 shows a perspective view of web conversion apparatus 10 from FIG. 1. Web conversion apparatus 10 includes ribbon guiding section 114, cutting assembly 30, former 28 and delivery section 106. Ribbons 14 enter web-conversion apparatus 10 and are converted into multiple signatures 32, 34, 36, 38, which may form individual final printed products.

Figure 3:
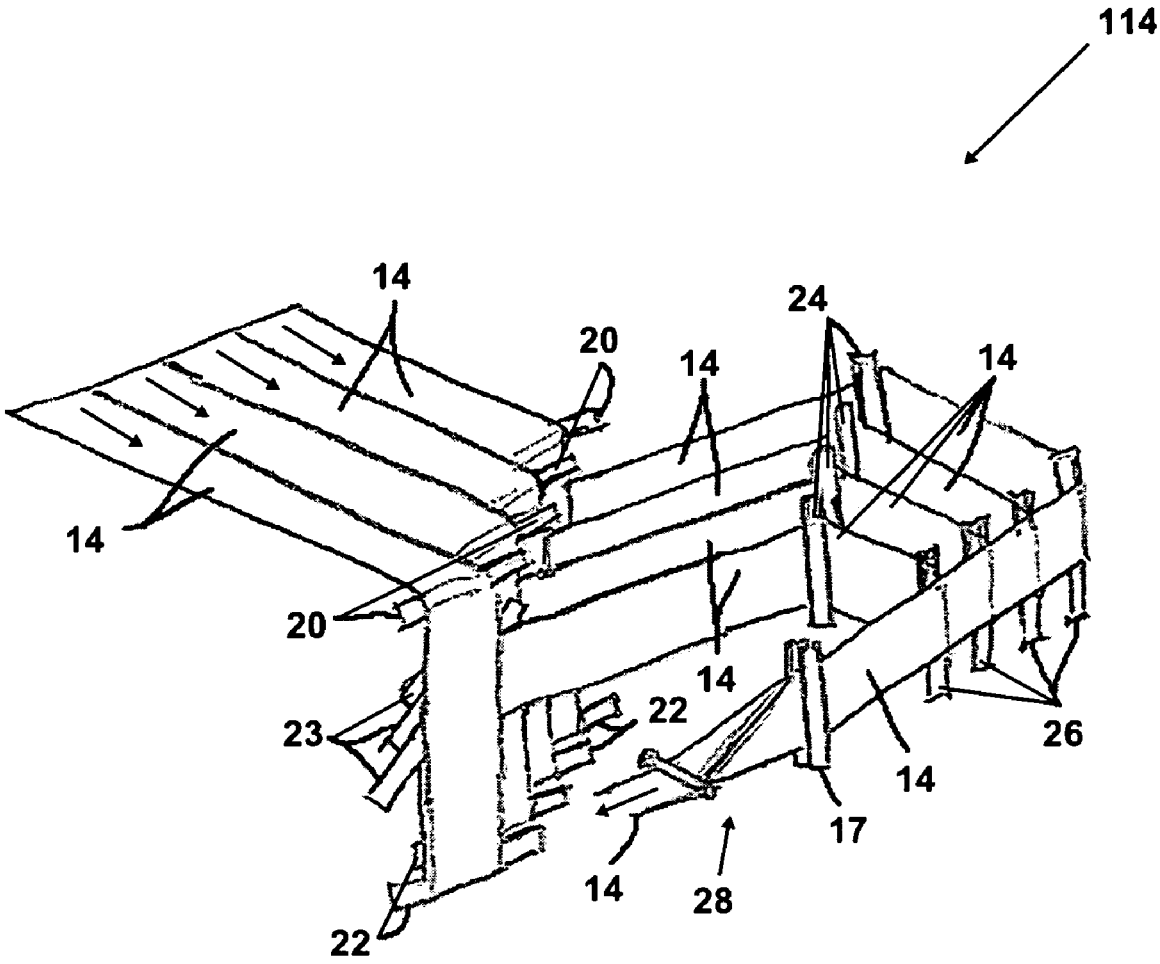
FIG. 3 shows an enlarged perspective view of a ribbon guiding section of the web-conversion apparatus shown in FIG. 2.

Ribbon guiding section 114, which is shown more clearly in FIG. 3, includes lead rolls 20, 24, compensators 22, angle bars 23 and pull rolls 26. Ribbons 14 are wrapped around and redirected by lead rolls 20, compensators 22, angle bars 23, pull rolls 24 and lead rolls 26 to ensure ribbons 42 are properly oriented as they enter former 28. Ribbons 14 enter ribbon guiding section 114 traveling substantially horizontal and are guided vertically by lead rolls 20 and compensators 22. Angle bars 23 redirect ribbons 14 so that ribbons 14 are transported horizontally, in an upright on-edge orientation, such that ribbons 14 are aligned vertically with one edge located above the other. Pull rolls 24 and lead rolls 26 reverse the horizontal direction of travel of ribbons 14, while maintaining the upright on-edge orientation of ribbons 14. The axes of rotation of pull rolls 24, lead rolls 26, and nip rolls 17 are aligned with the vertical direction, allowing ribbons 14 to transported horizontally into former 28. Ribbons 14 are merged on-edge by lead rolls 16. Ribbons 14 then pass between nip rolls 17 and are longitudinally folded by former 28.

Ribbon guiding section 114, which is shown more clearly in FIG. 3, includes lead rolls 20, 24, compensators 22, angle bars 23 and pull rolls 26. Ribbons 14 are wrapped around and redirected by lead rolls 20, 24, compensators 22, angle bars 23 and pull rolls 26 to ensure ribbons 14 are properly oriented as they enter former 28. Ribbons 14 enter ribbon guiding section 114 traveling substantially horizontal and are guided vertically by lead rolls 20 and compensators 22. Angle bars 23 redirect ribbons 14 so that ribbons 14 are transported horizontally, in an upright on-edge orientation, such that ribbons 14 are aligned as required vertically. Lead rolls 24 and pull rolls 26 can change the horizontal direction of travel of ribbons 14, while maintaining the upright on-edge orientation of ribbons 14. The axes of rotation of pull rolls 26, lead rolls 24, and nip rolls 17 are aligned with the vertical direction, allowing ribbons 14 to transported horizontally into former 28. Ribbons 14 are merged on-edge after pull rolls 26. Ribbons 14 pass between nip rolls 17 and are longitudinally folded by former 28.

Ribbons 14, once longitudinally folded, are aligned with the horizontal direction so that ribbons 14 are no longer oriented on-edge but instead are aligned substantially in the horizontal plane. Ribbons 14 are then cut by a cutting assembly 30 into four successive signatures 32, 34, 36, 38. Cylinders 48, 50, 148, 150 of cutting assembly 30 are rotated at appropriate frequencies so that knives on cut cylinders 48, 50 create signatures 32, 34, 36, 38 having desired lengths. Signatures 32, 34, 36, 38, having a horizontal orientation, are transported in the horizontal direction to respective diverting assemblies 52, 54, 56, 58, which alter the path of signatures and pass signatures 32, 34, 36, 38 to respective deceleration assemblies 62, 64, 66, 68, located below conveyor 40. Deceleration assemblies 62, 64, 66, 68, rotating about axes that are perpendicular to the horizontal direction that conveyor 40 transports signatures 32, 34, 36, 38, grip respective signatures 32, 34, 36, 38, and rotate signatures 32, 34, 36, 38 approximately 180 degrees with respect to the axes of deceleration assemblies 62, 64, 66, 68, respectively. Deceleration assemblies 62, 64, 66, 68 then release signatures 32, 34, 36, 38, now traveling in a direction opposite the transport direction of conveyor 40, to respective delivery assemblies 72, 74, 76, 78, which may carry signatures 32, 34, 36, 38 away from respective deceleration assemblies 62, 64, 66, 68 in a direction that is parallel to axes of respective deceleration assemblies 62, 64, 66, 68.

The present invention can be appreciated as delivering multiple cut-offs on multiple deliveries. A single group of ribbons may be converted into multiple printed products. For example, a strip of ribbons corresponding to the once-around circumferential printing length of each of the plate cylinders of the printing press may be converted in four different print products of four different lengths. Also, not all deceleration assemblies and delivery assemblies need to be active at the same time, so two printed products could be delivered by two deceleration and two delivery assemblies and two deceleration and two delivery assemblies could be inactive.

By transporting ribbons 14, and signatures 32, 34, 36, 38 primarily in the horizontal direction, the height of web conversion and delivery apparatus 10 is advantageously reduced. The reduced height may lower the ceiling height requirements of printing press facilities and decrease the need for press personnel to climb stairs to reach the various apparatus components. Since web conversion and delivery apparatus 10 can be operated from one level, web conversion and delivery apparatus 10 may thus be easier to operate. In the embodiment shown in FIGS. 1 and 2, web conversion and delivery apparatus 10 may be 38 feet long and 8 feet high. In another embodiment, a web conversion and delivery apparatus may be 54 feet long and 8 feet high and receive eight ribbons and create and deliver six different signatures.

In other embodiments, a second web may be printed by a second set of printing units, slit into ribbons by a second slitter and combined with ribbons 14 to create a ribbon bundle with an increased number of ribbons, which may be converted into signatures with an increased number of pages. Also, more or less than four ribbons 14 could be created by slitter 112 (FIG. 1) and delivered by ribbon guiding section 114. Deliveries 72, 74, 76, 78 may include grippers or other mechanisms to maintain positive control over signatures 32, 34, 36, 38 and ensure accurate delivery streams.

Figure 4:
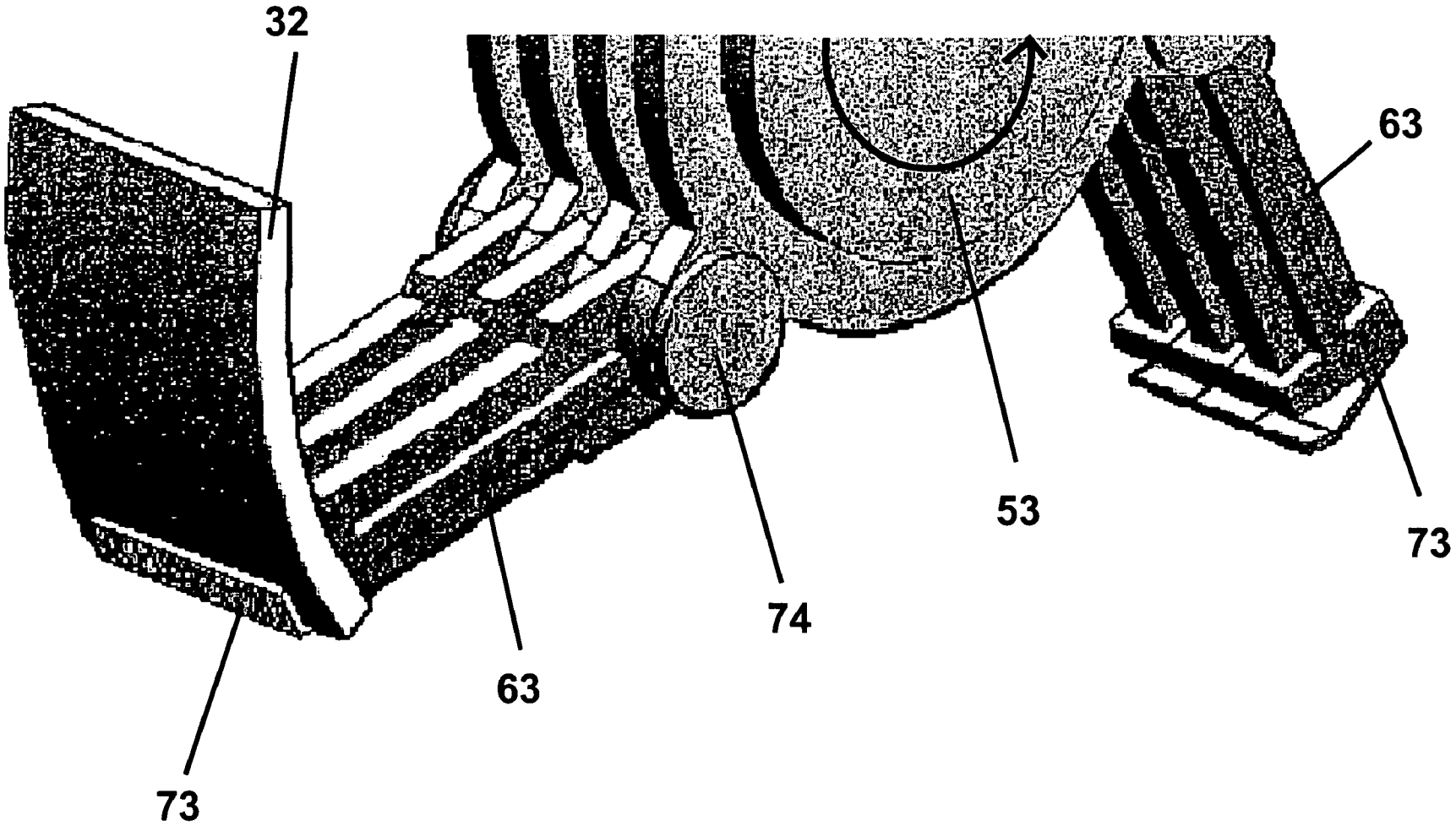
FIG. 4 shows an enlarged perspective view of a deceleration assembly shown in FIGS. 1 and 2 transporting a signature.

FIG. 4 shows an enlarged view of deceleration assembly 62 shown in FIGS. 1 and 2 transporting signature 32. Deceleration assembly 62 includes center body 53, arms 63 and grippers 73. Arms 63 are connected to 53 center body 53 by connectors 74. Grippers 73 engage signatures 32 and deliver signatures 32 to delivery assembly 72 (FIG. 2). Grippers 73 may clamp products to prevent signatures 32 from slipping out of grippers 73 or so the alignment of signatures 32 is not impaired. As deceleration assembly 62 is rotated counterclockwise about an axis of center body 53, arms 73 pass by delivery assembly 72 (FIG. 2) and grippers 73 release signatures 32 on top of delivery assembly 72. Arms 63 may be actuated about connectors 53 to ensure that grippers 73 are in appropriate positions to receive and release signatures 32.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A web conversion and delivery apparatus comprising:

a first delivery for transporting printed products;

a second delivery for transporting printed products; and a cutting apparatus upstream of the first delivery and the second delivery, the cutting apparatus capable during a first print job of cutting first images of the fixed image length into first printed products for delivery to the first delivery, the second delivery being inactive during the first print job, the cutting apparatus capable during a second print job of cutting second images of the fixed image length into second printed products for delivery to the first delivery and the second delivery, the second printed products having a length different from the first printed products;

a first diverter assembly diverting the first printed products from a plane to the first delivery; and a second diverter assembly diverting the second printed products from the plane to the second delivery.

2. The web conversion and delivery apparatus recited in claim 1 further comprising a conveyor downstream of the cutting apparatus and upstream of the first and second deliveries capable of transporting the first and second printed products away from the cutting apparatus.

3. The web conversion and delivery apparatus recited in claim 2 wherein the cutting apparatus during the second print job cuts each second image into a first second printed product and a second second printed product, the first diverter assembly diverting the first second printed products from the conveyor, the second second printed products passing by the first diverter assembly on the conveyor.

4. The web conversion and delivery apparatus recited in claim 3 wherein the second diverter assembly diverts the second second printed products from the conveyor.

5. The web conversion and delivery apparatus recited in claim 4 further comprising a first deceleration assembly and a second deceleration assembly, the first deceleration assembly receiving the first second printed products from the first diverter and transporting the first second printed products to the first delivery, the second deceleration assembly receiving the second second printed products from the second diverter and transporting the second second printed products to the second delivery apparatus.

6. The web conversion and delivery apparatus recited in claim 1 further comprising a third delivery downstream of the cutting apparatus for transporting printed products, the first printed products being delivered to the third delivery during the first print job, the second printed products being delivered to the third delivery during the second print job.

7. The web conversion and delivery apparatus recited in claim 6 further comprising a fourth delivery assembly downstream of the cutting apparatus for transporting printed products, the first printed products being delivered to the fourth delivery during the first print job, the second printed products being delivered to the fourth delivery during the second print job.

8. The web conversion and delivery apparatus recited in claim 7 wherein the first printed products are each approximately 14 and ⅔ inches long, the second printed products are approximately 11 inches long and the fixed image length is approximately 44 inches long.

9. A printing press comprising:

a printing unit for printing images of a fixed image length on a web;

a slitter downstream of the printing unit for slitting the web into at least two ribbons;

a former downstream of the printing unit for longitudinally folding the at least two ribbons;

a first delivery for transporting printed products;

a second delivery for transporting printed products; and a cutting apparatus upstream of the first delivery and the second delivery cutting the web as the web travels in a first plane arranged above a second plane in which the first and second deliveries transport printed products, the cutting apparatus capable during a first print job of cutting first images of the fixed image length into first printed products for delivery to the first delivery, the second delivery being inactive during the first print job, the cutting apparatus capable during a second print job of cutting second images of the fixed image length into second printed products for delivery to the first delivery and the second delivery, the second printed products having a length different from the first printed products.

10. The web conversion and delivery apparatus recited in claim 9 further comprising a third delivery downstream of the cutting apparatus for transporting printed products, the first printed products being delivered to the third delivery during the first print job, the second printed products being delivered to the third delivery during the second print job.

11. The web conversion and delivery apparatus recited in claim 10 further comprising a fourth delivery assembly downstream of the cutting apparatus for transporting printed products, the first printed products being delivered to the fourth delivery during the first print job, the second printed products being delivered to the fourth delivery during the second print job.

12. The web conversion and delivery apparatus recited in claim 11 wherein the first printed products are each approximately 14 and ⅔ inches long, the second printed products are approximately 11 inches long and the fixed image length is approximately 44 inches long.

13. A method of producing and delivering printed products of variable lengths comprising:

cutting first images of a fixed image length on a printed web with a cutting apparatus to create first printed products for a first print job;

transporting the first printed products a first delivery, a second delivery being inactive during the first print job;

transporting the first printed products to a third delivery during the first print job;

cutting second images of the fixed image length on a printed web with a cutting apparatus to create second printed products for a second print job, the second printed products having a length different from the first printed products;

transporting the second printed products to the first delivery and the second delivery; and transporting the second printed products to a third delivery during the second print job.

14. The method recited in claim 13 wherein the step of cutting the second images includes cutting each second image into a first second printed product and a second second printed product, the step of transporting the second printed products including transporting the first second printed products and the second second printed products away from the cutting apparatus with a conveyor and diverting the first second printed products from the conveyor to the first delivery and diverting the second second printed products from the conveyor to the second delivery.

15. The method recited in claim 14 wherein the step of transporting the second printed products further includes decelerating the first second printed products after the first second printed products are diverted from the conveyor and before the first second printed products reach the first delivery and decelerating the second second printed products after the second second printed products are diverted from the conveyor and before the second second printed products reach the second delivery.

16. The method recited in claim 13 further comprising:

transporting the first printed products to a fourth delivery during the first print job; and transporting the second printed products to a fourth delivery during the second print job.

17. The method as recited in claim 16 wherein the first printed products are each approximately 14 and ⅔ inches long, the second printed products are each approximately 11 inches long, and the fixed image length is approximately 44 inches.

18. The web conversion and delivery apparatus recited in claim 1 further comprising at least one servomotor, the cutting apparatus including at least one cutting cylinder, the at least one servomotor driving the at least one cutting motor at a faster average velocity during the second print job than the first print job.

19. The web conversion and delivery apparatus recited in claim 18 further comprising a controller controlling the at least one servomotor and the second delivery, the controller increasing the average rotational velocity of the cutting apparatus between the first and second print jobs, the controller activating the second delivery between the first and second print jobs.

20. The printing press recited in claim 9 further comprising at least one servomotor, the cutting apparatus including at least one cutting cylinder, the at least one servomotor driving the at least one cutting motor at a faster average velocity during the second print job than the first print job.

21. The printing press recited in claim 20 further comprising a controller controlling the at least one servomotor and the second delivery, the controller increasing the average rotational velocity of the cutting apparatus between the first and second print jobs, the controller activating the second delivery between the first and second print jobs.

* * * * *

UNITED STATES PATENT AND TRADEMARK OFFICE

CERTIFICATE OF CORRECTION

PATENT NO. : 8,020,847 B2
APPLICATION NO. : 12/322768
DATED : September 20, 2011
INVENTOR(S) : Douglas Joseph Dawley It is certified that error appears in the above-identified patent and that said Letters Patent is hereby corrected as shown below:

Column 9, line 56, of claim 13:

"transporting the first printed products a first delivery..."

should read

"transporting the first printed products to a first delivery..."

Signed and Sealed this
Thirty-first Day of January, 2012

David J. Kappos

David J. Kappos
*Director of the United States Patent and Trademark Office*